US008376693B2

(12) United States Patent
Gilman et al.

(10) Patent No.: US 8,376,693 B2
(45) Date of Patent: Feb. 19, 2013

(54) VARIABLE VANE ASSEMBLY

(75) Inventors: Justin P. Gilman, Indianapolis, IN (US); Andrew J. Eifert, Indianapolis, IN (US)

(73) Assignee: Rolls-Royce PLC, London (GB)

( * ) Notice: Subject to any disclaimer, the term of this patent is extended or adjusted under 35 U.S.C. 154(b) by 466 days.

(21) Appl. No.: 12/588,880

(22) Filed: Oct. 30, 2009

(65) Prior Publication Data

US 2010/0189549 A1 Jul. 29, 2010

(30) Foreign Application Priority Data

Jan. 26, 2009 (GB) ..... 0901139.6

(51) Int. Cl.
*F01D 17/16* (2006.01)

(52) U.S. Cl. ..... 415/160

(58) Field of Classification Search ..... 415/159, 415/160, 152, 150, 148, 163, 164, 165, 166
See application file for complete search history.

(56) References Cited

U.S. PATENT DOCUMENTS 3,736,070 A 5/1973 Moskowitz et al.
3,841,788 A 10/1974 Sljusarev et al.
3,841,790 A * 10/1974 Stein et al. ..... 415/159

FOREIGN PATENT DOCUMENTS

JP 04314973 A * 11/1992

OTHER PUBLICATIONS

Office Action issued for British Application No. 0901139.6 on Apr. 24, 2009.

* cited by examiner

*Primary Examiner* — Richard Edgar
(74) *Attorney, Agent, or Firm* — Oliff & Berridge, PLC

(57) ABSTRACT

A variable vane assembly, for example of stator vanes in a gas turbine engine, comprises vanes which can be turned together about their longitudinal axes by means of a unison ring which is turned by an actuator about the engine axis. The unison ring is coupled to the vanes by levers. The unison ring has varying stiffness along its circumference, increasing in the direction away from the drive point at which the actuator acts. The varying stiffness may be achieved by varying the radial thickness of the unison ring. The unison ring is thus able to resist ovalization so that the vanes move together.

7 Claims, 6 Drawing Sheets

View IV - IV

View IV - IV

View VI - VI

VARIABLE VANE ASSEMBLY

This invention relates to a variable vane assembly comprising an array of variable vanes coupled to a unison ring for common displacement upon rotation of the unison ring about its central axis, and is particularly, although not exclusively, concerned with such an assembly in a gas turbine engine.

Variable vane assemblies are widely used to control the flow of a fluid, usually air or combustion products, through various compression and expansion stages of gas turbine engines. Typically, they comprise Inlet Guide Vanes (IGVs) or Stator Vanes (SVs) disposed within the flow passages of the engine adjacent to rotor blade assemblies, usually in the compressor stages or fans of the engine although variable stator vanes may also be used in power turbines. Air passing between the vanes is directed at an appropriate angle of incidence for the succeeding rotating blades.

Each vane in a variable vane assembly is rotatably mounted about its longitudinal axis within the flow path of a compressor or turbine. The vane is connected at its radially outer end to a lever which, in turn, is pivotally connected to a unison ring. The unison ring is mounted on carriers so that it is rotatable about its central axis, which coincides with the engine axis.

Rotation of the unison ring is usually achieved by means of a single actuator, or two diametrically oppositely disposed actuators, acting on the ring. The or each actuator exerts a tangential load on the unison ring thereby causing the ring to rotate about its central axis. Rotation of the unison ring actuates each of the levers causing the vanes to rotate, in unison, about their respective longitudinal axes. The vanes can thus be adjusted in order to control the flow conditions within the respective compressor or turbine stages.

The vanes exert a reaction load on the unison ring which can deform it from its nominal circular shape. This radial deformation, or ovalisation, introduces variation in the angular positions of the variable vanes. Such variation affects compressor or turbine performance, and consequently reduces the overall efficiency of the engine.

The radial stress acting at a given location of the unison ring is dependent on the load being applied and the circumferential distance from the actuator. The radial stress is thus greatest at locations furthest away from the region at which the load is applied, which, for a single actuator unison ring, is diametrically opposite the actuator.

For small diameter unison rings, the radial stiffness of the ring is generally sufficient to resist excessive deformation. However, increasing the diameter of a unison ring decreases its radial stiffness. Large diameter unison rings are therefore susceptible to excessive ovalisation.

Ovalisation can be reduced by employing an additional actuator to distribute the actuation force about the circumference of the ring. The additional actuator and associated mechanism increases the overall weight and cost of the variable vane assembly. This, nevertheless, may be desirable in the interests of reliability, since the unison ring can still be driven even if one actuator fails.

In this specification, terms such as "radial", "axial" and "circumferential" refer to the rotational axis of the unison ring which is substantially aligned with the longitudinal axis of the gas turbine engine, unless otherwise stated.

According to the present invention there is provided a variable vane assembly comprising an array of variable vanes coupled to a unison ring for common displacement upon rotation of the unison ring about its central axis by means of a force applied at a drive point on the unison ring, characterised in that the radial stiffness of the unison ring varies in the circumferential direction.

The radial stiffness of the cross-section of the unison ring may vary over at least 50% of the circumferential extent of the unison ring. Furthermore, the radial stiffness may increase in a circumferential direction away from the drive point and may vary progressively, i.e. as a continuous, possibly linear function, with distance from the drive point.

A radial dimension of the cross-section of the unison ring may vary circumferentially to provide the variation in radial stiffness.

The unison ring may comprise a first member having a uniform cross-section and a second reinforcing member, in which the reinforcing member may have a cross-section which varies circumferentially.

The variable vane assembly may further comprise an actuator for rotating the unison ring about its central axis. The actuator may be positioned at a position of minimum stiffness of the unison ring.

The variable vane assembly may further comprise a second actuator, which may be diametrically opposite the first actuator.

The unison ring may have a rectangular (such as square), or I-shaped or U-shaped cross-section.

The present invention also provides a gas turbine engine comprising a variable vane assembly as outlined above.

For a better understanding of the present invention, and to show more clearly how it may be carried into effect, reference will now be made, by way of example, to the accompanying drawings, in which.

Figure 3:
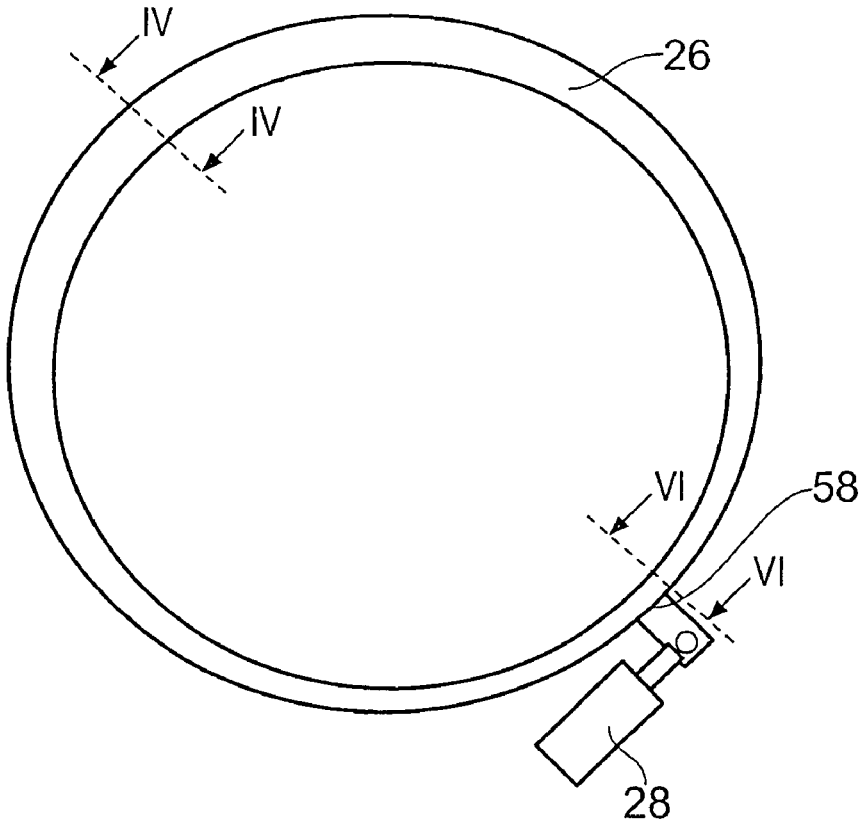
FIG. 3 is a schematic representation of a unison ring and actuator of the variable vane assembly of FIG. 2.
Figure 4:
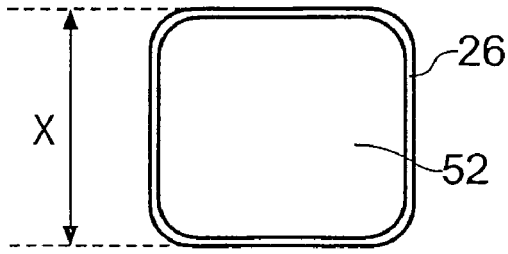
FIG. 4 is a sectional view taken on the line VI-VI in FIG. 3.
Figure 5:
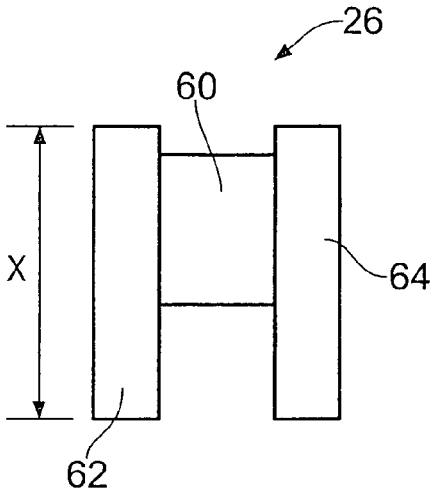
Figure 6:
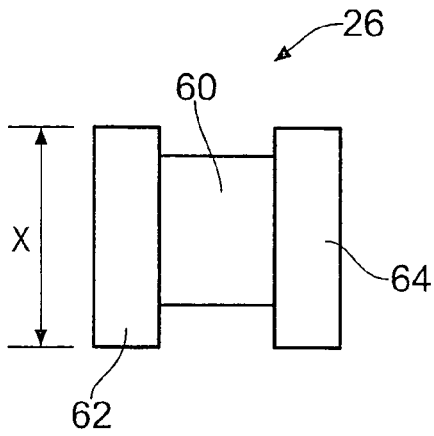
Figure 7:
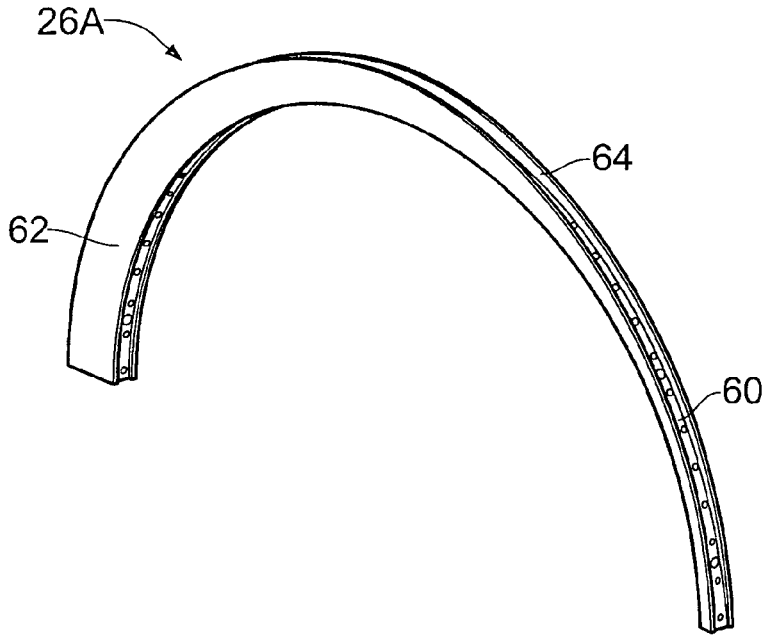
Figure 8:
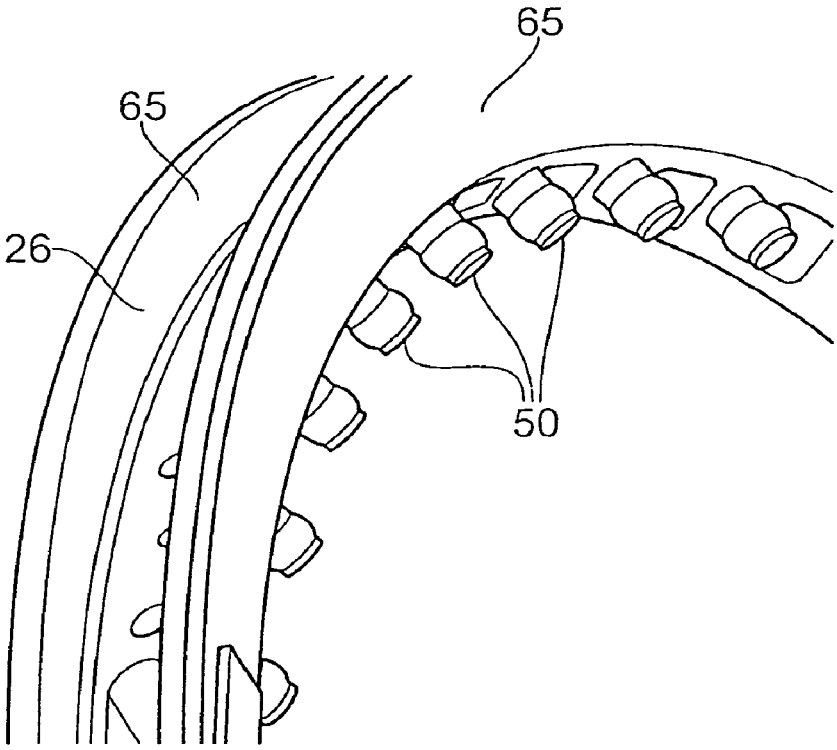
Figure 9:
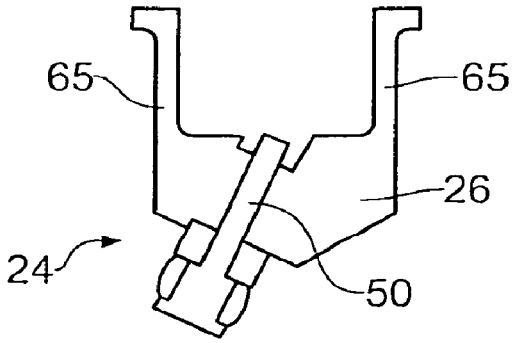

FIG. 5 corresponds to FIG. 4 but shows an alternative configuration of the unison ring;

FIG. 6 is a sectional view taken on the line VI-VI in FIG. 3, showing the unison ring of FIG. 5;

FIG. 7 is a perspective view of a segment of the unison ring shown in FIGS. 5 and 6;

FIG. 8 shows a further variant of a unison ring;

FIG. 9 is a sectional view of the unison ring of FIG. 8; and

Figure 10:
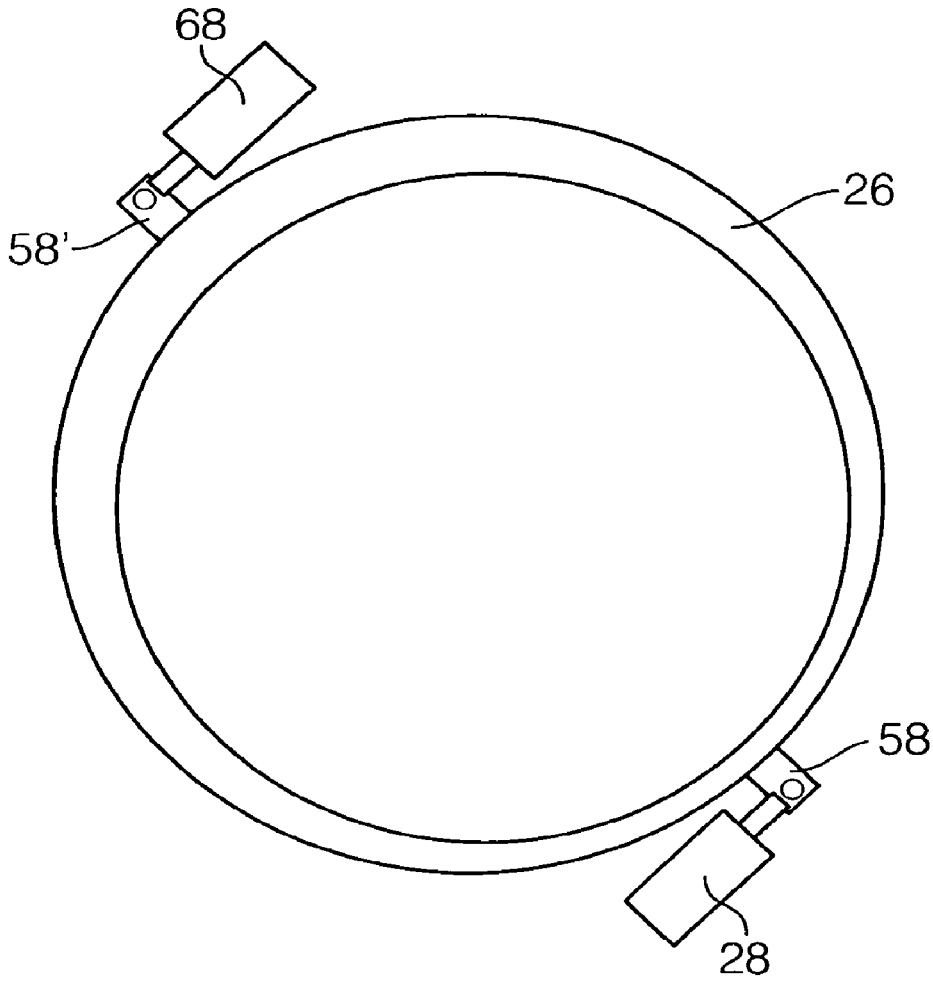

FIG. 10 corresponds to FIG. 3, but shows a unison ring provided with two actuators.

Figure 1:
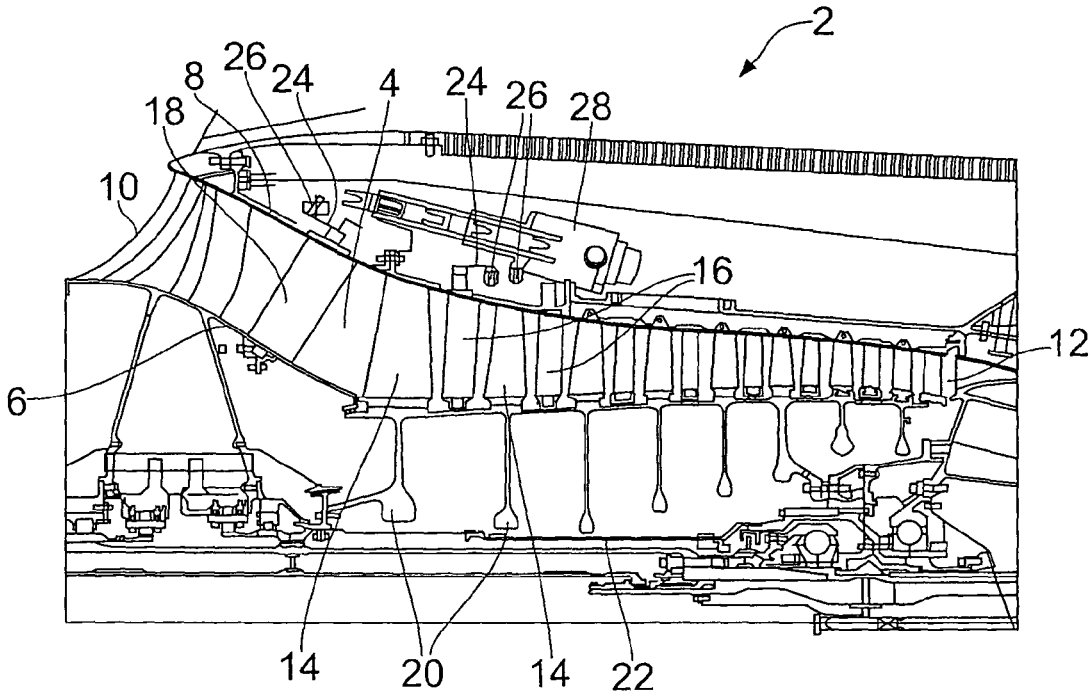
FIG. 1 is a sectional view of compressor stages of a gas turbine engine.

The compressor 2 shown in FIG. 1 comprises an annular flow passage 4 defined between an inner annular wall 6 and an outer annular wall 8. The annular flow passage 4 extends along the length of the compressor 2. The compressor 2 has an inlet 10 and an outlet 12 which coincide with respective ends of the flow passage 4. The flow direction is defined as the general direction of the flow from the inlet 10 to the outlet 12.

The flow passage 4 has a series of compression stages along its length. Each compression stage comprises an array of rotor blades 14 disposed within the flow passage 4 and an array of stator vanes 16 disposed adjacent to, and downstream of, the rotor blades 14. Both the rotor blades 14 and stator vanes 16 extend across the flow passage 4 from the inner wall 6 to the outer wall 8 in a substantially radial direction. The rotor blades 14 and the stator vanes 16 have an aerofoil shaped cross-section.

An array of inlet guide vanes 18 is provided within the flow passage 4 upstream of the compressor stages. Each inlet guide vane 18 extends across the flow passage 4 in a direction which is substantially perpendicular to the inner and outer walls 6,8.

Each rotor blade 14 is connected to a radial disk 20 which, in turn, is connected to a driveshaft 22. The rotational axis of the driveshaft 22 coincides with the engine axis. Rotation of the driveshaft 22 causes the rotor blades 14 to rotate about the longitudinal axis of the engine within the annular flow passage 4.

During operation, a gas (usually air) is drawn through the compressor inlet 10 and along the flow passage 4. As the gas flows along the flow passage 4 it passes between the inlet guide vanes 18. The inlet guide vanes 18 direct flow to impinge on the first rotor blades 14 at an appropriate angle of incidence. The gas is then drawn through each successive compression stage by the rotor blades 14 before being exhausted through the compressor outlet 12.

As the gas passes through each stage of compression, the rotary motion of the rotor blades 14 generates a circulating flow within the flow passage 4. This circulating flow then passes between the stator vanes 16 which serve to reduce circulation in the flow passage 4 after each stage of compression. The gas is therefore redirected by the stator vanes 16 to arrive at the succeeding rotor blades 14 at an appropriate angle for further compression. The amount of flow redirection required is dependent on the operating conditions of the engine, in particular, the speed of the rotor blades 14. Consequently, the optimum angular position of the stator vanes 16 with respect to the nominal flow direction varies during normal operation. The stator vanes 16 are therefore rotatably mounted at each end so that they are rotatable about their respective longitudinal axes. This allows the angular position of each stator vane 16 to be varied with respect to the flow direction.

As shown in FIG. 1, the inlet guide vanes 18, the stator vanes 16 belonging to the first compression stage and the stator vanes 16 belonging to the second compression stage are each provided with a respective unison ring 26. Each unison ring 26 is disposed radially outward of, and concentric with, the annular flow passage 4. Furthermore, the unison rings 26 are supported by guide members (not shown) which support the unison rings 26 for rotation about the engine axis. The unison rings 26 are connected to a common actuator 28 for actuation of all three rings 26 simultaneously, the respective rotation of each ring 26 being dependent on the mechanical advantage provided between the actuator 28 and the ring 26.

The principle of operation of each variable vane assembly and its respective unison ring 26 is substantially the same. Discussion of the construction and operation of a variable vane assembly will therefore be confined to the single variable vane assembly shown in FIG. 2.

Figure 2:
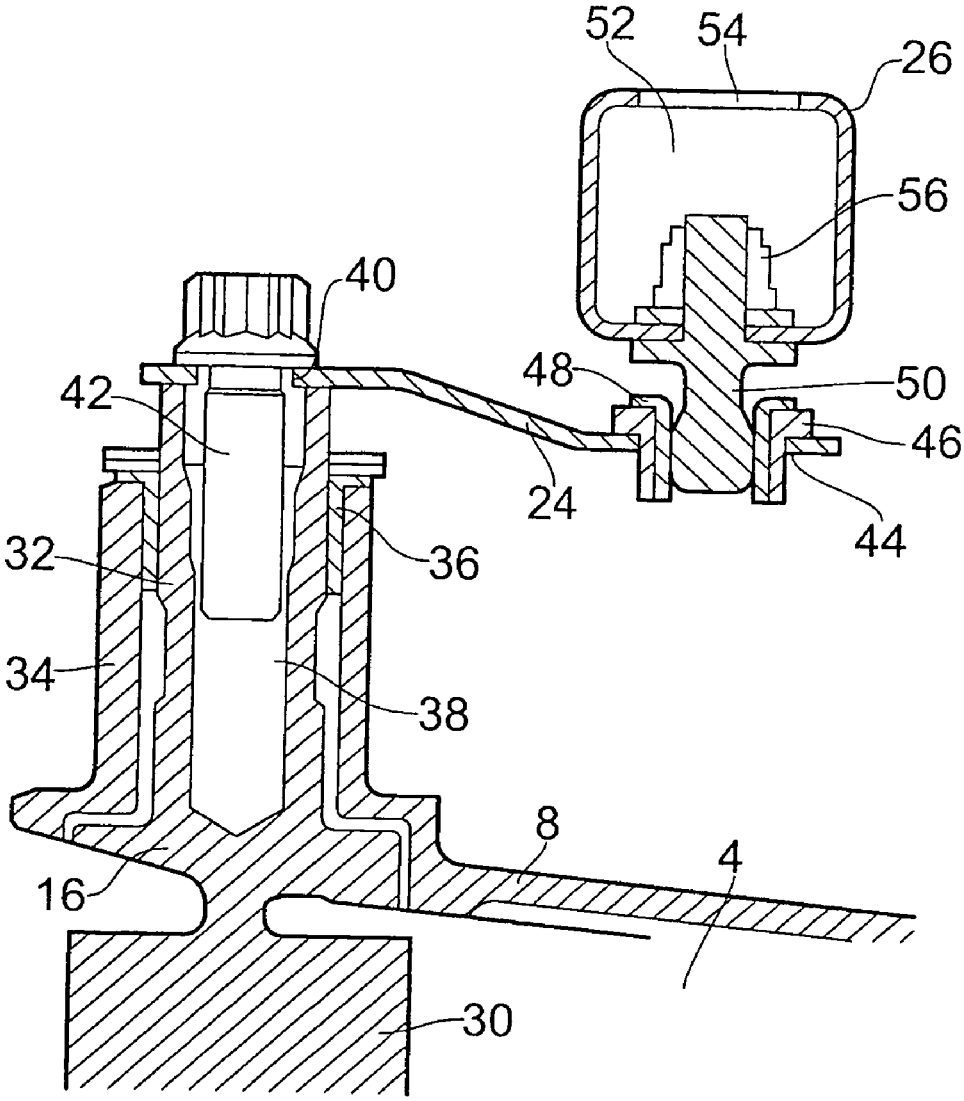
FIG. 2 is a fragmentary sectional view of part of a variable vane assembly of the gas turbine engine of FIG. 1.

FIG. 2 shows a stator vane 16 disposed between the outer wall 8 and the inner wall 6 (not shown) of the flow passage 4 as described above. The stator vane 16 comprises an aerofoil section 30 disposed within the flow passage 4, and a cylindrical portion 32 which extends radially outwardly through the outer wall 8. The outer wall 8 is provided with a cylindrical protrusion 34 which extends radially outwardly from the flow passage 4 and supports the cylindrical portion 32 of the stator vane 16 for rotation by means of bearings 36.

The cylindrical portion 32 of the stator vane 16 is provided with a partially threaded bore 38 which is aligned with the longitudinal axis of the cylindrical portion 32. The bore 38 extends along the length of the cylindrical portion 34 and is open at its radially outer end. A lever 24 having a first circular aperture 40 at one end, which corresponds with the diameter of the threaded bore 38, is secured to the vane 16 by a bolt 42 which extends through the first aperture 40 provided in the lever 24 and engages with the thread of the bore 38.

The lever 24 extends laterally from the vane 16, and a second circular aperture 44 is provided at the other end of the lever 24. Sleeves 46, 48 serve as bushings for an enlarged head of a pin 50 which extends from within the second sleeve 48 in a radially outward direction along the axis of the second sleeve 48.

The pin 50 is secured to the unison ring 26 which is disposed radially outwardly of the lever 24, by a nut 56. The unison ring 26 has a hollow rectangular cross-section which defines an annular cavity 52, and has openings 54 providing access to the nut 56.

The unison ring 26 is mounted on carriers (not shown) which support the unison ring 26 for rotation about its axis. Rotation of the unison ring 26 acts through the lever 24 to cause the stator vane 16 to rotate with respect to the flow passage 4. By appropriately adjusting the amount of rotation of the unison ring 26, the angle of the stator vane 16 with respect to the flow direction through the flow passage 4 can be controlled to produce the desired flow conditions. All of the stator vanes 16 of the array are coupled to the unison ring 26 in the same manner, and so rotation of the unison ring 26 causes rotation of all of the vanes 16 together.

FIG. 3 provides a schematic representation of a unison ring 26 driven by a single actuator 28 which acts at a drive point 58 on the unison ring 26. The radial thickness of the unison ring 26 increases progressively in a circumferential direction away from the drive point 58 to a region of maximum radial thickness diametrically opposite the drive point 58. In the embodiment shown in FIG. 3, the internal diameter of the unison ring 26 is circular, and centred on the axis of rotation of the unison ring. The outer periphery of the unison ring 26 is thus non-circular, and/or eccentric to the axis of rotation to provide the varying radial thickness.

The actuator 28 comprises a ram mechanism which is secured to the engine casing and has an actuator rod which is pivotally connected to the unison ring 26 such that linear actuation of the ram mechanism exerts a tangential load on the unison ring 26 which causes the unison ring 26 to rotate.

It will be further appreciated that the cross-section of the unison ring 26 may take any form provided that the stiffness of the unison ring 26 varies in a circumferential direction. For example, the unison ring 26 may have a constant radial thickness but be provided with a reinforcement of varying stiffness. It will be appreciated that references in this specification to variation in stiffness refer to variations over a significant circumferential extent, and exclude small-scale differences caused, for example, by fastening holes and similar features on the unison ring 26.

FIG. 4 is a schematic representation of the view IV-IV of the unison ring 26 shown in FIG. 3 having a substantially rectangular, almost square, cross-section with a varying radial thickness X. Variation in the thickness of the unison ring 26 which is dictated by the radial stress experienced avoids unnecessary strengthening of the unison ring 26 which would otherwise lead to an unnecessary increase in the overall weight of the variable vane assembly.

An alternative embodiment of the invention, as shown in FIGS. 5 to 7, comprises a unison ring 26 comprising a first member 60 and first and second reinforcing plates 62, 64. The first member 60 has a circumferentially uniform rectangular cross-section. The first and second reinforcing plates 62, 64 each have a radial thickness X which varies circumferentially about the unison ring 26 from a minimum at the drive point 58 to a maximum at a point diametrically opposite the drive point 58. The reinforcing plates 62, 64 are secured to opposite faces of the first member 60. This type of modular construction avoids the complexity involved in the manufacture of a single-element unison ring 26 of varying thickness. Furthermore, reinforcing plates 62, 64 can be retro-fitted to existing unison rings. It will be appreciated that the cross-section of each of the plates 62, 64 may differ with respect to each other, or that only one of the plates 62, 64 may have a varying cross-section. It will also be appreciated that only one reinforcing plate need be provided, and that this may be combined with the first member 60 in a variety of ways including, but not limited to, as an external or internal rib. As indicated in FIG. 7, the unison ring may be formed in two or more segments 26A to assist assembly with the engine.

The cross-section of the unison ring 26 may be I-shaped or, as shown is FIGS. 8 and 9, the unison ring 26 may have a substantially U-shaped cross-section. The limbs 65 of the unison ring 26 may vary in length around the circumference in order to provide the required variation in radial stiffness.

FIG. 10 shows an alternative embodiment of the variable vane assembly in which the unison ring 26 is provided with a second actuator 68, which acts at a second drive point 58' diametrically opposite the first actuator 28, which acts at drive point 58 (i.e., a first drive point). The second actuator is thus provided adjacent to the region of maximum radial thickness, and therefore radial stiffness, of the unison ring 26. The second actuator 68 can be used to reduce the stress applied to the unison ring 26 and/or to provide redundancy in the event of actuator failure. It will be appreciated that the second actuator 68 may be disposed at any position about the circumference of the unison ring 26, including at a position which is adjacent to the first actuator 28. The second actuator may be a slave driven unit coupled to the first actuator 28.

In all of the above embodiments, the variation in radial stiffness of the unison ring resulting from the varying radial thickness tends to stiffen the unison ring at regions away from the drive point 58. Consequently the tendency of the unison ring to deform from the circular unstressed configuration is reduced, without an excessive penalty in terms of cost and weight.

The invention claimed is:

1. A variable vane assembly comprising:

a unison ring having a radial stiffness that varies in a circumferential direction thereof;

an array of variable vanes coupled to the unison ring for common displacement upon rotation of the unison ring about its central axis by means of a force applied at a first drive point and at a second drive point on the unison ring;

a first actuator that is: i) configured to rotate the unison ring about its central axis, and ii) connected to the unison ring at the first drive point, the first drive point being positioned in a region of minimum stiffness on the unison ring; and a second actuator that is: i) configured to rotate the unison ring about its central axis, and ii) connected to the unison ring at the second drive point, the second drive point being positioned in a region that is diametrically opposite to the region of minimum stiffness.

2. The variable vane assembly as claimed in claim 1, wherein the radial stiffness of the unison ring varies over at least 50% of a circumference of the unison ring.

3. The variable vane assembly as claimed in claim 1, wherein the radial stiffness varies progressively with distance from the first drive point and the second drive point.

4. The variable vane assembly as claimed in claim 1, wherein a radial dimension of a cross-section of the unison ring varies circumferentially to provide variation in the radial stiffness.

5. The variable vane assembly as claimed in claim 1, wherein the unison ring comprises a first member having a uniform cross-section and a second reinforcing member providing variation in the radial stiffness.

6. The variable vane assembly as claimed in claim 5, wherein the second reinforcing member has a cross-section which varies circumferentially.

7. A gas turbine engine comprising the variable vane assembly in accordance with claim 1.

* * * * *